US007788785B2

(12) United States Patent
Platt

(10) Patent No.: US 7,788,785 B2
(45) Date of Patent: Sep. 7, 2010

(54) METHOD OF CONNECTING A FENCE RAIL TO A FENCE POST USING A RAIL CLIP ASSEMBLY

(76) Inventor: Robert E. Platt, 8701 Highland Ave., Mineral Ridge, OH (US) 44440

( * ) Notice: Subject to any disclaimer, the term of this patent is extended or adjusted under 35 U.S.C. 154(b) by 0 days.

(21) Appl. No.: 12/500,670

(22) Filed: Jul. 10, 2009

(65) Prior Publication Data

US 2009/0267041 A1 Oct. 29, 2009

Related U.S. Application Data

(63) Continuation of application No. 11/485,849, filed on Jul. 12, 2006, now Pat. No. 7,568,680, which is a continuation-in-part of application No. 11/405,840, filed on Apr. 18, 2006, now abandoned.

(51) Int. Cl.
*B23P 11/00* (2006.01)
*E04H 17/00* (2006.01)

(52) U.S. Cl. ..... 29/525.01; 29/469; 29/434; 29/897.3

(58) Field of Classification Search ..... 256/1, 256/19, 65.01, 65.02, 65.03, 65.04, 65.05, 256/65.12, 67, 69, DIG. 2; 29/897.3, 897.31, 29/469, 525.01, 434
See application file for complete search history.

(56) References Cited

U.S. PATENT DOCUMENTS

| | | | | |
|---|---|---|---|---|
| 2,941,855 | A | 6/1960 | Weill | |
| 3,233,871 | A | 2/1966 | Schroer | |
| 3,867,048 | A | 2/1975 | Endzweig | |
| 4,355,919 | A | 10/1982 | Lievonen | |
| 4,386,870 | A | 6/1983 | Baroody | |
| 4,570,906 | A | 2/1986 | Walden | |
| 5,083,390 | A | 1/1992 | Edman | |
| 5,370,368 | A | 12/1994 | Terrels et al. | |
| 5,788,224 | A | 8/1998 | Platt | |
| 6,805,335 | B2 | 10/2004 | Williams | |
| 6,811,346 | B2 | 11/2004 | Liao | |
| 6,993,843 | B2 * | 2/2006 | Quaintance et al. | 29/897.31 |
| 7,007,363 | B2 | 3/2006 | Forbis | |
| 7,125,002 | B2 * | 10/2006 | Platt | 256/65.04 |
| 7,216,855 | B2 * | 5/2007 | Platt | 256/65.03 |
| 7,427,055 | B2 * | 9/2008 | Platt | 256/65.06 |
| 7,568,680 | B2 * | 8/2009 | Platt | 256/65.04 |
| 2010/0108969 | A1 * | 5/2010 | Platt | 256/65.04 |

* cited by examiner

*Primary Examiner*—Essama Omgba
(74) *Attorney, Agent, or Firm*—Sand & Sebolt

(57) ABSTRACT

A method of using a rail clip assembly to connect a horizontal fence rail to a vertical fence post. The rail clip assembly includes a housing that is slidably engaged with at least one mounting spacer and a first leg of an L-shaped mounting bracket until a second leg of the bracket abuts the underside of the housing. A first fastener is screwed through the first leg and mounting spacer and into the side wall of the fence post. An end of the rail is inserted into the housing and a second fastener is screwed through the second leg, the housing and the end of the rail. The rail clip assembly aids in preventing the rail from disengaging from the housing when a lateral force is applied to the rail.

20 Claims, 7 Drawing Sheets

METHOD OF CONNECTING A FENCE RAIL TO A FENCE POST USING A RAIL CLIP ASSEMBLY

CROSS-REFERENCE TO RELATED APPLICATIONS

This is a continuation of U.S. patent application Ser. No. 11/485,849, filed Jul. 12, 2006, now U.S. Pat. No. 7,568,680, which is a continuation-in-part of U.S. patent application Ser. No. 11/405,840, filed Apr. 18, 2006, now abandoned, the entire specifications of which are incorporated herein.

BACKGROUND OF THE INVENTION

1. Technical Field

This invention generally relates to fencing systems. More particularly, the invention relates to a method of using a rail clip assembly for securing a fence rail to a fence post. Specifically, the invention relates to a method of securing a fence rail and post together with a rail clip assembly that reduces the tendency of the rail from disengaging from the fence post when a lateral force is applied to the rail.

2. Background Information

A variety of rail clips have been proposed in the prior art for connecting vinyl fence rails to vinyl fence posts. These clips have typically included a mounting base portion that is secured to the rail and which includes a rail-end shaped receptacle to receive the end of the rail therein. One of the reasons these rail clips have been used is to provide a neat, finished connection between the two components. The clips hide incorrectly cut rail ends, evidence of previous attempts to connect the rail and post together and the apparent elimination of gaps between the connected rail ends and the posts. In order to provide a more aesthetically-pleasing device, it is common for the rail clip to be in the magnitude of one to two inches deep. Rail clips that are deeper than this tend to give the rail a cumbersome appearance.

A second consideration when connecting fence rails to fence posts is the existence of rules and regulations governing building standards. In recent years, building codes have required that the rail clip provided must ensure that the end of the rail cannot pop out of the rail clip when a lateral force is applied to the rail. In other types of rail connectors, the rail clip itself is slidably engaged with a mounting base that is first secured to post. In this type of situation, the rail clip has tended to pop off the mounting base, thereby releasing the rail.

There is therefore a need in the art for a rail clip assembly that will connect a horizontal rail to a vertical post and that will resist the tendency for the rail to pop out of the clip when a lateral force is applied to the rail.

SUMMARY OF THE INVENTION

A method of using a rail clip assembly to connect a horizontal fence rail to a vertical fence post is disclosed. The rail clip assembly includes a housing that is slidably engaged with at least one mounting spacer and a first leg of an L-shaped mounting bracket until a second leg of the bracket abuts the underside of the housing. A first fastener is screwed through the first leg and mounting spacer and into the side wall of the fence post. An end of the rail is inserted into the housing and a second fastener is screwed through the second leg, the housing and the end of the rail. The rail clip assembly aids in preventing the rail from disengaging from the housing when a lateral force is applied to the rail.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

DETAILED DESCRIPTION OF THE INVENTION

Figure 1:
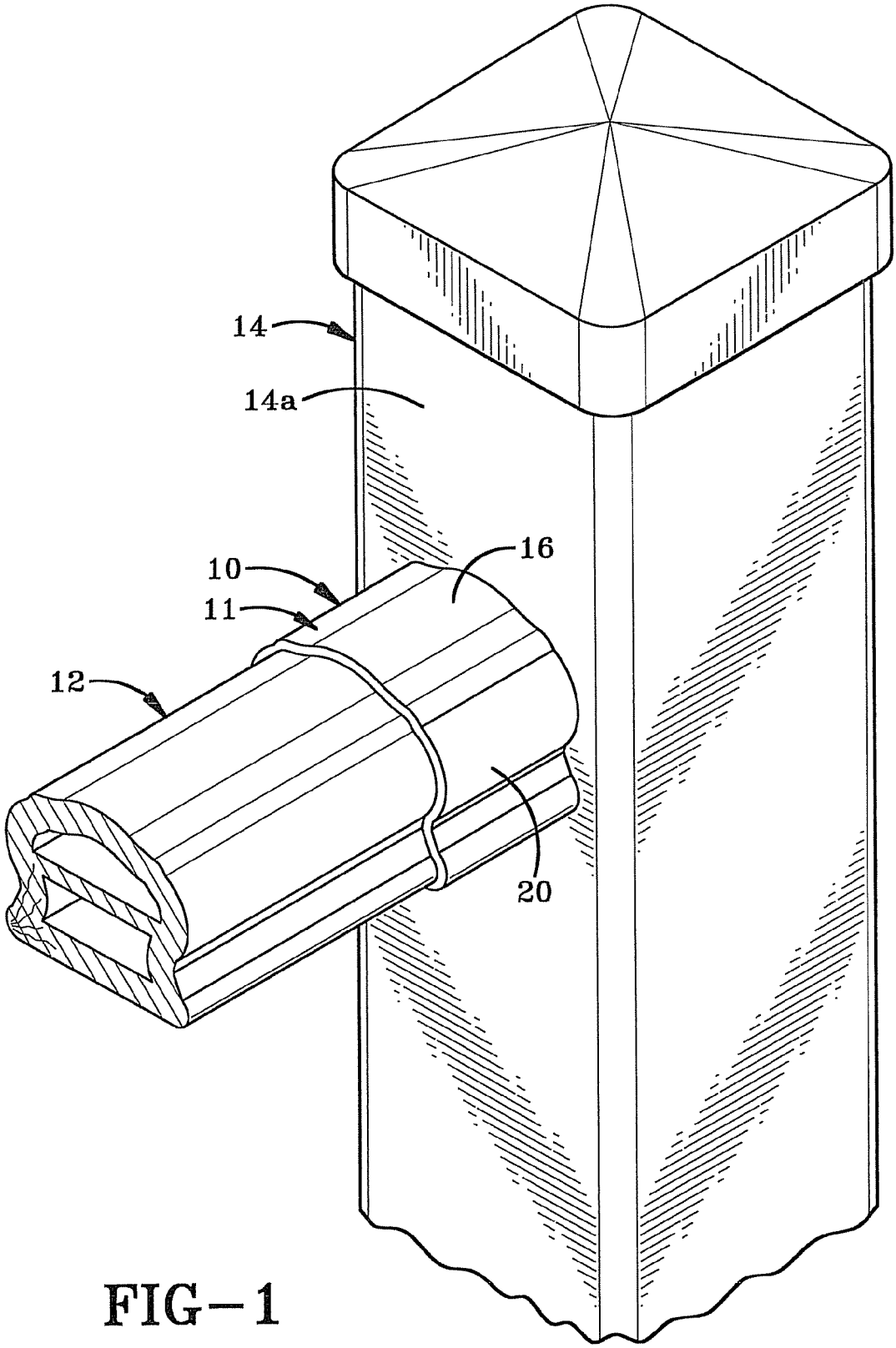
FIG. 1 is a perspective view of a fence rail connected to a fence post using the rail clip assembly of the present invention.

Referring to FIG. 1, there is shown a rail clip assembly in accordance with the present invention and being generally indicated at 10. Rail clip assembly 10 is shown in FIG. 1 securing a substantially horizontal fence rail 12 to a substantially vertical fence post 14. Both rail 12 and post 14 are preferably manufactured from vinyl or fiber composite fencing materials.

Figure 2:
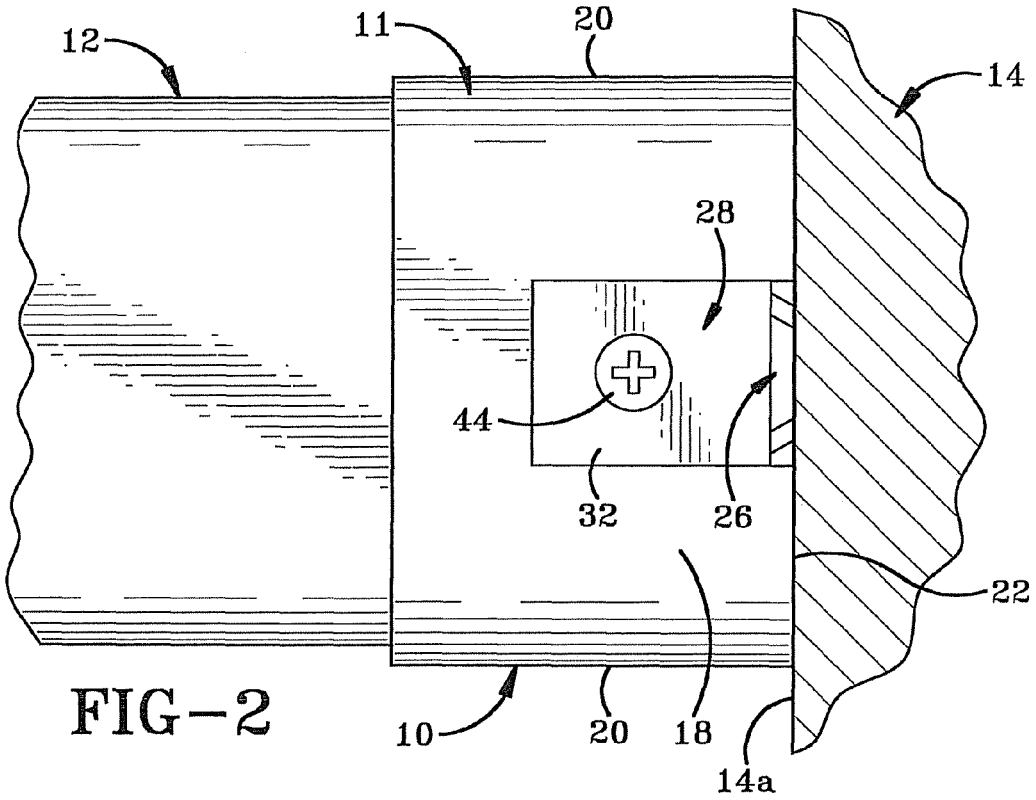
FIG. 2 is a partial cross-sectional bottom view of the fence rail and rail clip assembly of FIG. 1.
Figure 9:
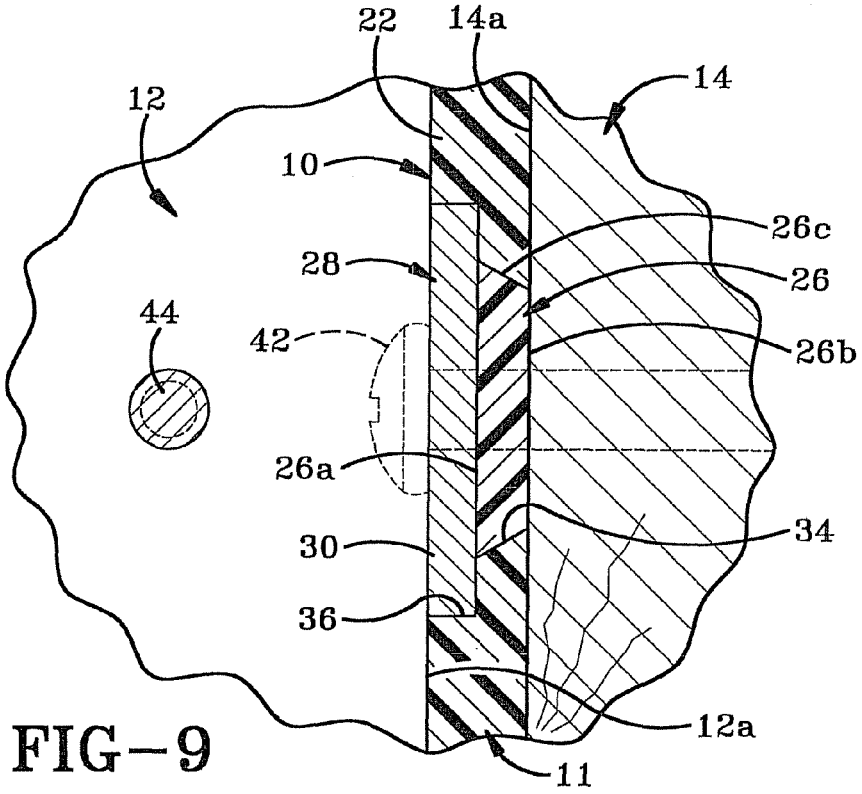
FIG. 9 is top view through line 9-9 of FIG. 7.
Figure 3:
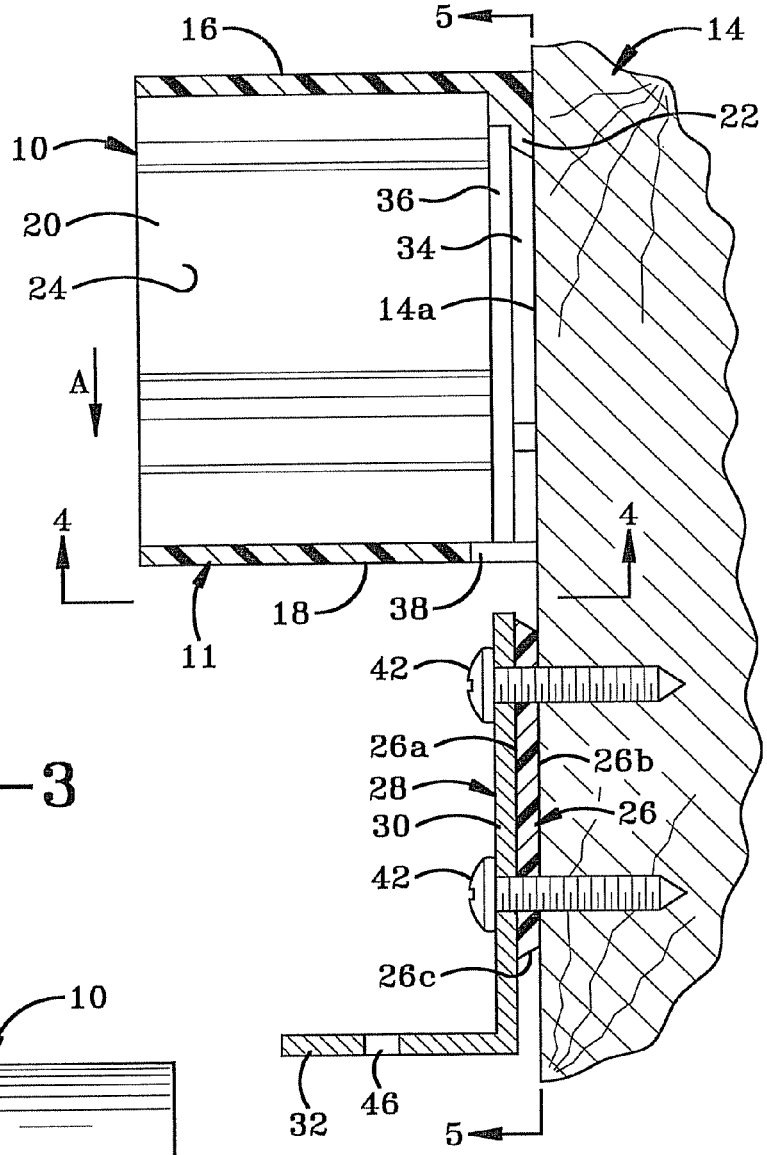
FIG. 3 is a cross-sectional side view of a fence rail being engaged with the rail clip assembly of the present invention.
Figure 4:
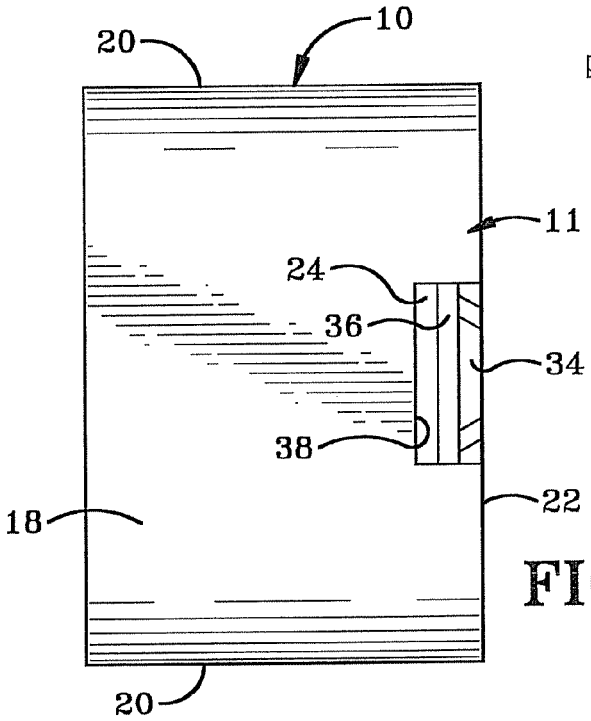
FIG. 4 is a bottom view of the rail clip assembly through line 4-4 of FIG. 3.

Referring to FIGS. 2-4, rail clip assembly 10 preferably includes a housing 11 having a perimeter wall that comprises a top wall 16, a bottom wall 18, and side walls 20. Walls 16, 18 and 20 extend outwardly away from a rear wall 22. These walls preferably are integrally manufactured with each other by a process such as molding. The walls 16-22 surround and define an interior chamber 24 that is adapted to receive an end of rail 12 therein. Chamber 24 is complementary sized and shaped to snugly receive the end of rail 12 therein.

Figure 5:
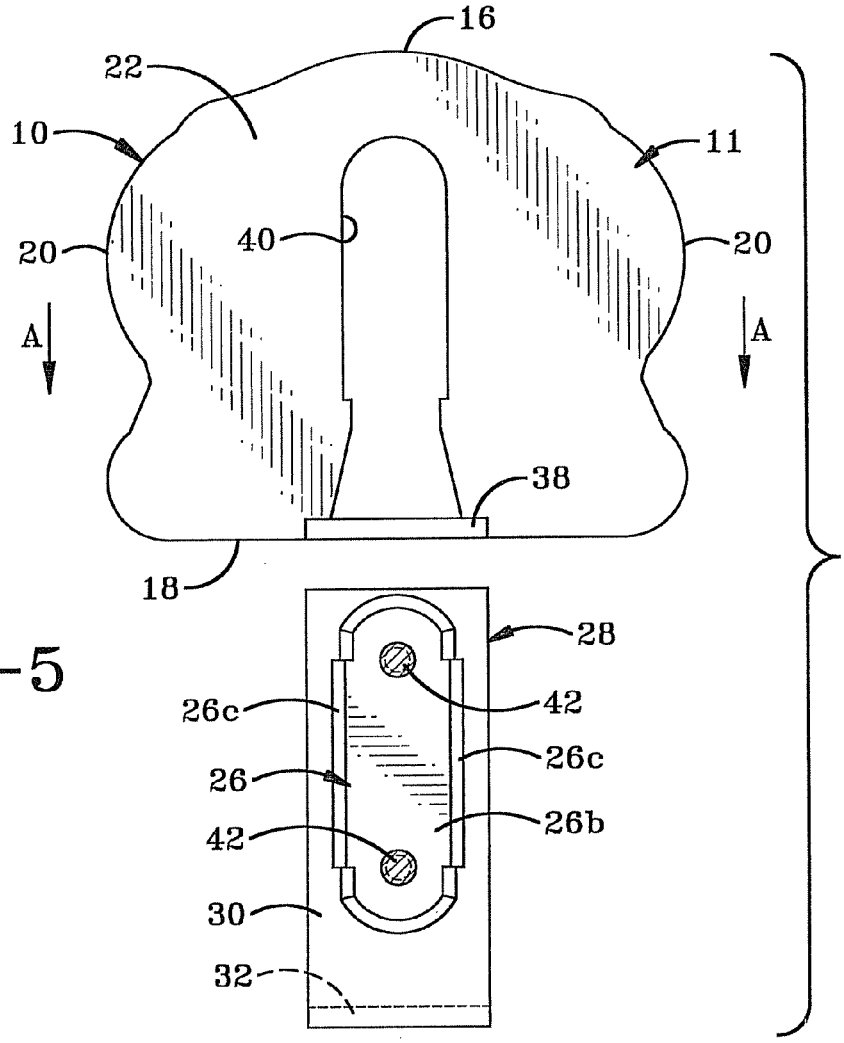
FIG. 5 is a rear view of the rail clip assembly, mounting bracket and mounting base taken through line 5-5 of FIG. 3.
Figure 8:
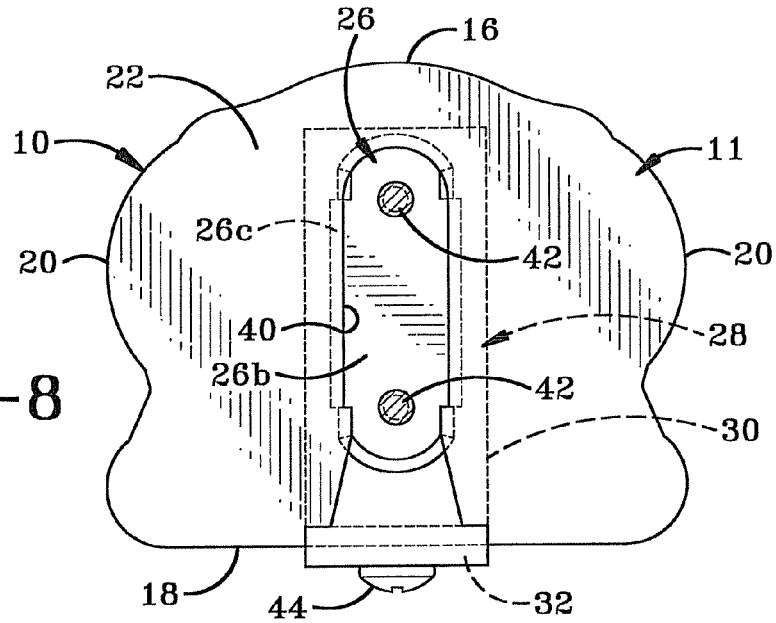
FIG. 8 is a rear view of the rail clip assembly engaged with the rail and taken through line 8-8 of FIG. 7.

Housing 11 of rail clip assembly 10 is designed to be secured to post 14 by two components, namely a mounting base 26 and an L-shaped mounting bracket 28. Base 26 is a substantially planar member having a front surface 26*a* and a back surface 26*b* and a peripheral wall 26*c*. As shown in FIGS. 3 & 5, peripheral wall 26*c* tapers from front surface 26*a* to back surface 26*b*. Base 26 preferably is manufactured from the same material as housing 11. Bracket 28 comprises a substantially L-shaped member having a first leg 30 and a second leg 32. Preferably, bracket 28 is manufactured from a suitable metal. Housing 11 is designed to engage both base 26 and bracket 28. Housing 11 includes a complementary tapered first recess 34 that is configured to tightly receive base 26 therein. Rail clip assembly further includes a second recess 36 that is differently shaped to first recess 34, and is configured to receive the first leg 30 of bracket 28 therein. First and second recesses preferably are substantially continuous with each other. Furthermore, second recess 36 is also substantially continuous with interior cavity 24 of housing 11. An opening 38 (FIG. 4) to both of first and second recesses 34, 36 is provided in bottom wall 18 of housing 11. Recess 34 preferably also has an opening 40 (FIG. 5) in rear wall 22 of housing 11. Opening 40 is smaller than the back surface 26*b* of base 26 so that base 26 cannot pass through opening 40.

Referring to FIG. 3, rail clip assembly 10 is used in the following manner to secure rail 12 to post 14. Back surface 26*b* of base 26 is placed into abutting contact with the outer surface 14*a* of post 14. The first leg 30 of the L-shaped bracket 28 is placed into abutting contact with front surface 26*a* of base 26. Fasteners 42 are used to secure both first leg 30 of bracket 28 and base 26 to post 14. It will be understood that both the first leg 30 and base 26 preferably are provided with appropriate holes for receiving fasteners 42 therethrough, so that the correct positioning of the two components is ensured. Alternatively, however, holes may be drilled through first leg 30 and base 26 during installation of rail clip assembly 10. When bracket 28 and base 26 are secured to post 14, the second leg 32 of bracket 28 extends outwardly away from the exterior wall of post 14 and substantially at right angles thereto.

Figure 6:
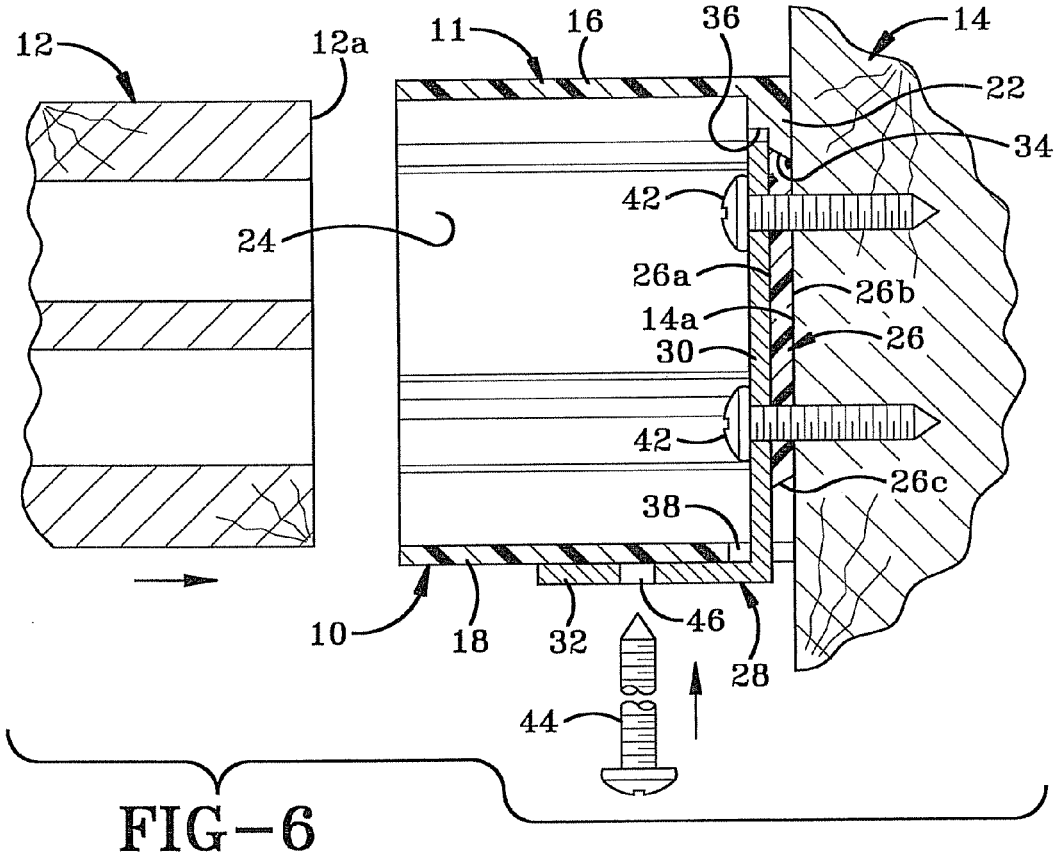
FIG. 6 is cross-sectional side view of the rail being inserted into the rail clip assembly.
Figure 7:
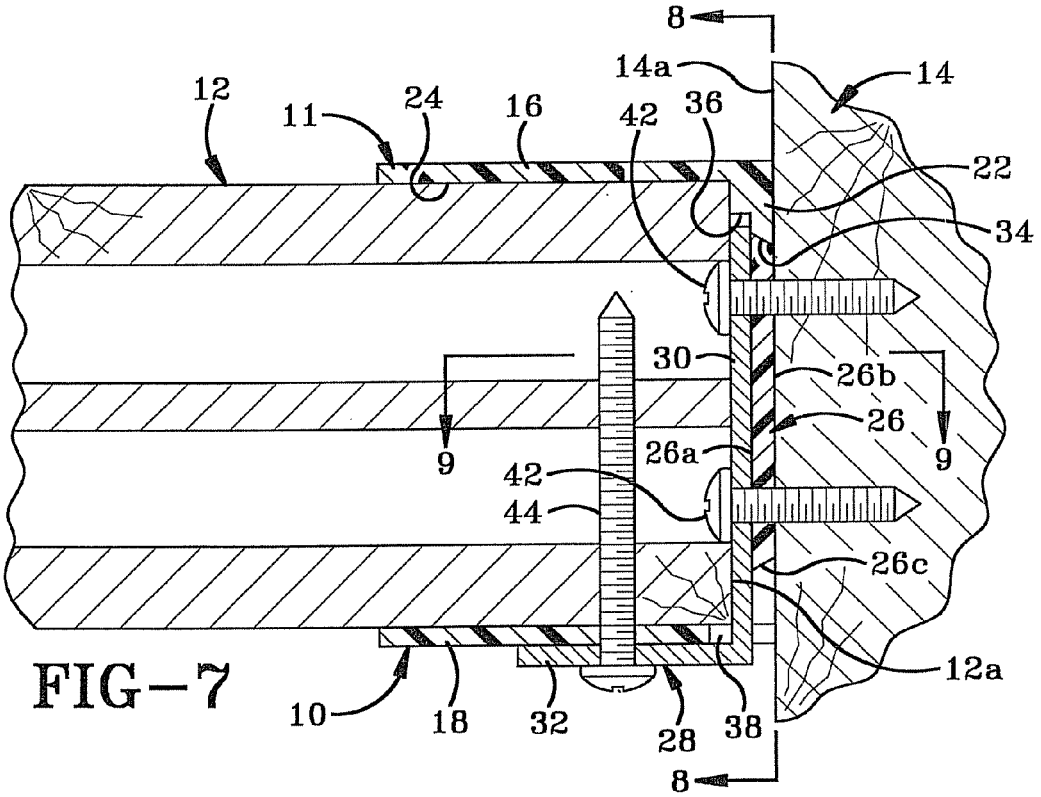
FIG. 7 is a cross-sectional side view of the rail secured to the rail clip assembly.

Rear wall 22 of housing 11 is then placed in abutting contact with outer surface 14*a* of post 14 and is slid downwardly in the direction of arrow "A" (FIGS. 3&5). This downward movement causes the uppermost ends of base 26 and first leg 30 of bracket 28 to enter first and second recesses 34, 36. Housing 11 is moved downwardly until bottom wall 18 abuts second leg 32 of bracket 28. An end of rail 12 is then inserted into cavity 24 of housing 11 (FIG. 6). Once the outermost end 12*a* abuts a portion of rear wall 22 of housing 11 and first leg 30 of bracket 28, a second fastener 44 is inserted through hole 46 in bracket 28 and is screwed through bottom wall 18 of housing 11 and into rail 12 (FIG. 7). This securement substantially prevents rail 12 from being withdrawn from cavity 24. Furthermore, the fastener 44 also prevents rail 12 from being moved laterally and causing rail 12 and rail clip assembly 10 to be dislodged from base 26.

Figure 10:
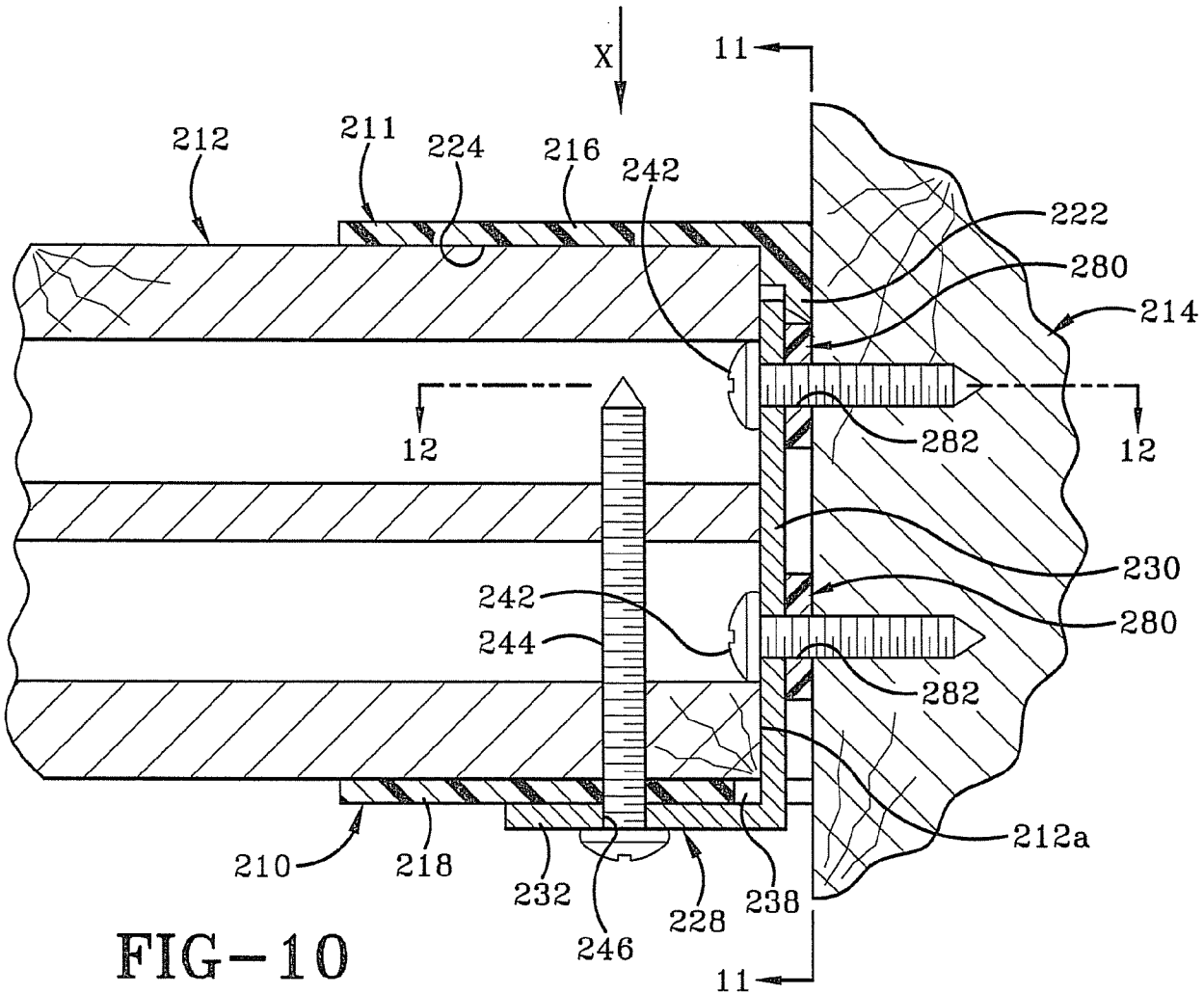
FIG. 10 is a cross-sectional side view of a second embodiment of the rail clip assembly in accordance with the present invention.
Figure 11:
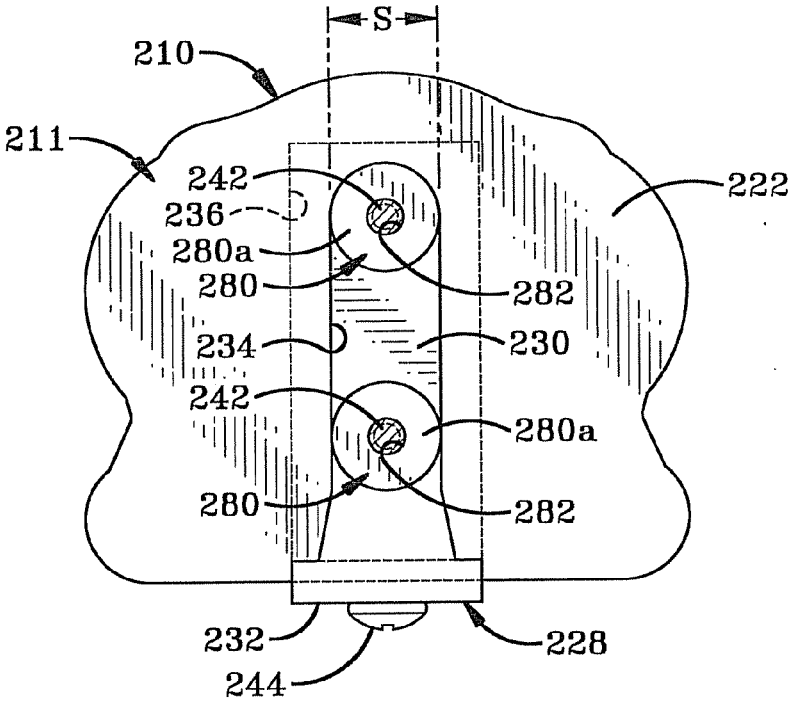
FIG. 11 is a rear view of the rail and rail clip assembly through line 11-11 of FIG. 10.
Figure 12:
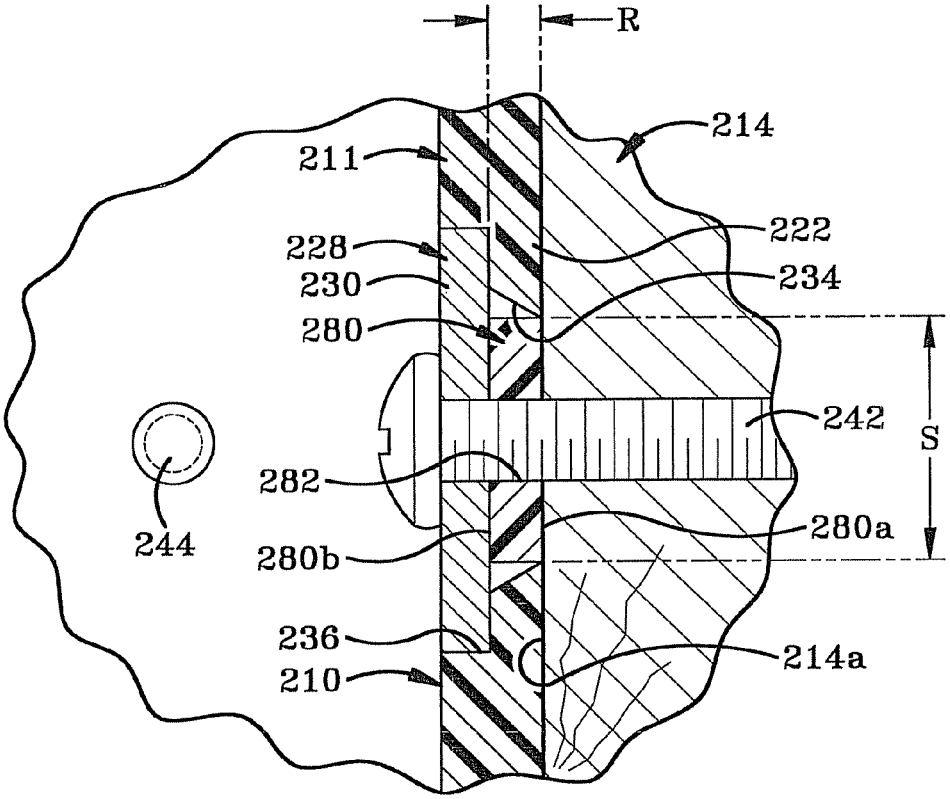
FIG. 12 is a top view of the rail and rail clip assembly through line 12-12 of FIG. 10.

FIGS. 10-12 show an alternative embodiment of a rail clip assembly in accordance with the present invention and generally indicated at 210. Rail clip assembly 210 is substantially identical to clip 10 in that it includes a housing 211 having a perimeter wall that comprises a top wall 216, a bottom wall 218, side walls (not shown) and a rear wall 222. The walls 216-222 surround and define an interior chamber 224 that is adapted to receive an end of rail 212 therein. Rear wall 222 is provided with a tapered first recess 234 and a second recess 236 that is contiguous therewith. First recess 234 is smaller in area than is second recess 236. Bottom wall 218 of housing 211 includes a first aperture 238 therein that is sufficiently wide enough to receive both first leg 230 of mounting bracket 228 and mounting spacer 280 therethrough as shown in FIG. 12.

Housing 211 is designed to be secured to post 214 by one or more mounting spacers 280 and an L-shaped mounting bracket 228. Mounting spacers 280 are used in the place of base 26 and are washer-like members that are sized to be received within the tapered first recess 234 in housing 211. First recess 234 has a depth "R" (FIG. 12) and each mounting spacer 280 has a substantially equal thickness "R". First recess 234 further has a narrowest width "S" and each mounting spacer has a diameter that is substantially equal to that width "S". Mounting spacers 280 preferably are manufactured from the same material as housing 211 and have a back surface 280*a*, a front surface 280*b* and a central aperture 282 therein. Bracket 228 is substantially identical to bracket 28 and is complementary shaped to be received within second recess 236 in housing 211.

Rail clip assembly 210 is used in the following manner to secure rail 212 to post 214. Back surface 280*a* of each mounting spacer 280 is placed into abutting contact with the outer surface 214*a* of post 214. The first leg 230 of the L-shaped bracket 228 is placed into abutting contact with front surfaces 280*b* of mounting spacers 280. Fasteners 242 are used to secure both first leg 230 of bracket 228 and mounting spacers 280 to post 214. It will be understood that both the first leg 230 and mounting spacers 280 preferably are provided with appropriate holes, such as central aperture 282 in mounting spacers 280, for receiving fasteners 242 therethrough. This ensures the correct positioning of the components. Alternatively, however, holes may be drilled through first leg 230 and mounting spacers 280 during installation of rail clip assembly 210. When bracket 228 and mounting spacers 280 are secured to post 214, the second leg 232 of bracket 228 extends outwardly away from the exterior wall of post 214 and substantially at right angles thereto.

Rear wall 222 of housing 211 is then placed in abutting contact with outer surface 214*a* of post 214 and is slid downwardly in the direction of arrow "X" (FIG. 10). This downward movement causes mounting spacers 280 and first leg 230 of bracket 228 to enter first and second recesses 234,236, respectively. Housing 211 is moved downwardly until bottom wall 218 abuts second leg 232 of bracket 228. An end of rail 212 is then inserted into cavity 224 of housing 211. Once the outermost end 212*a* abuts a portion of rear wall 222 of housing 211 and first leg 230 of bracket 228, a second fastener 244 is inserted through hole 246 in bracket 228 and is screwed through bottom wall 218 of housing 211 and into rail 212 (FIG. 10). This securement substantially prevents rail 212 from being withdrawn from cavity 224. Furthermore, the fastener 244 also prevents rail 212 from being moved laterally and causing rail 212 and housing 211 to be disengaged from base 226.

Fence rail 212 may be connected to fence post 214 in a different manner. In this second manner mounting spacer 280 is inserted into vertical slot 234 in rear wall 222 of rail clip housing 211 and first leg 230 of L-shaped mounting bracket 228 is inserted into aperture 238 in peripheral wall 218 of the rail clip housing 211. Mounting bracket 228 is slid upwardly into interior cavity 224 of rail clip housing 211 such that the rear surface of first leg 230 is in abutting contact with both an interior surface of the rear wall 222 of the rail clip housing 211 and with the interior surface 280b of mounting spacer 280. Mounting bracket 228 is slid upwardly until second leg 232 thereof abuts an exterior surface of the peripheral wall 218. At this point, an aperture in said first leg 230 is aligned with aperture 282 in mounting spacer 280. A rear surface of rail clip housing 211 is placed in abutting contact with outer surface 214*a* of the side wall of fence post 214. A first fastener 242 is inserted through the aligned apertures in the first leg mounting spacer 280 and is screwed into the side wall of fence post 214. The end 212*a* of rail 212 in inserted into interior cavity 224 of rail clip housing 211 and a second fastener 244 is inserted through aperture 246 in second leg 232 of mounting bracket 228, and is screwed through the peripheral wall 218 of rail clip housing 211 and into rail 212.

The step of sliding the mounting spacer 280 into slot 234 in rear wall 222 preferably also includes the steps of aligning aperture 236 in the rear wall 222 over an end of mounting spacer 280 and then sliding mounting spacer 280 inwardly into the slot 234 until the end of mounting spacer 280 abuts an interior end surface of rear wall 222.

As discussed previously, more than one mounting spacer 280 may be used to abut a rear wall of first leg 230 and be thereby interposed between first leg 230 and the side wall of fence post 214. In this instance, a second aperture in the first leg 230 of mounting bracket 228 is aligned with an aperture 282 in the second mounting spacer 280 and an additional first fastener 242 is inserted through the aligned second aperture in the first leg 230 and aperture 282 in second mounting spacer 280 and is screwed into the side wall of the fence post 214 a distance away from the first fastener 242.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A method of connecting a fence rail to a fence post, said method comprising the steps of:

positioning a first mounting spacer against a side wall of a fence post;

positioning a first leg of an L-shaped mounting bracket against the first mounting spacer;

inserting a first fastener through the first mounting spacer, the first leg and the side wall of the fence post;

engaging a rail clip housing with the first mounting spacer; whereby a rear wall of the housing abuts the side wall of the fence post, the first leg of the mounting bracket is received within an interior chamber of the housing and a second leg of the mounting bracket is disposed in abutting contact with an exterior surface of a perimeter wall of the housing;

inserting an end of the fence rail into the interior chamber of the housing;

inserting a first fastener through the second leg of the mounting bracket, through the perimeter wall of the housing and into a wall of the rail.

2. The method as defined in claim 1, wherein the step of inserting the first fastener through the first mounting spacer and the first leg includes the step of:

aligning an aperture in the first leg with an aperture in the first mounting spacer; and inserting the first fastener through the aligned apertures in the first leg and first mounting spacer.

3. The method as defined in claim 1, further comprising the step of:

drilling an aperture through the first leg;

drilling an aperture through the first mounting spacer, aligning the aperture in the first leg with the aperture in the first mounting spacer; and inserting the first fastener through the aligned apertures.

4. The method as defined in claim 1, wherein the step of positioning the mounting bracket against the first mounting spacer further comprises the steps of:

placing the first leg of the mounting bracket against an interior surface of the first mounting spacer; and placing an exterior surface of the first mounting spacer in abutting contact with the side wall of the fence post.

5. The method as defined in claim 1, wherein the step of engaging the rail clip housing with the first mounting spacer includes:

sliding the rail clip housing downwardly over the first mounting spacer so that the first mounting spacer enters a vertically aligned slot in the rear wall of the housing.

6. The method as defined in claim 5, further comprising the step of:

aligning an aperture in a bottom wall of the housing over an upper end of the first mounting spacer prior to sliding the rail clip housing downwardly over the first mounting spacer.

7. The method as defined in claim 1, wherein the step of engaging the rail clip with the first mounting spacer includes the step of:

sliding the rail clip housing downwardly over the first mounting spacer until an exterior surface of a peripheral wall of the rail clip housing comes into abutting contact with the second leg of the mounting bracket.

8. The method as defined in claim 7, further comprising the steps of:

inserting a second fastener through the second leg of the mounting bracket, the peripheral wall of the rail clip housing and a wall of the rail.

9. The method as defined in claim 8, further comprising the steps of:

aligning an aperture in the second leg with an aperture in the peripheral wall of the rail clip housing and with an aperture in the wall of the rail; and inserting the second fastener through the aligned apertures in the second leg, peripheral wall and wall.

10. The method as defined in claim 8, further comprising the step of:

drilling an aperture through the second leg;

drilling an aperture through the peripheral wall of the rail clip housing;

drilling a hole through the wall of the rail;

aligning the aperture in the second leg with the aperture in the peripheral wall and with the aperture in the wall of the rail; and inserting the second fastener through the aligned apertures.

11. The method as defined in claim 1, further comprising the steps of:

positioning a second mounting spacer against the side wall of the fence post a distance away from the first mounting spacer;

positioning the first leg of the L-shaped mounting bracket against the second mounting spacer at the same time as positioning the first leg thereof against the first mounting spacer; and inserting a first fastener through the first leg of the mounting bracket, through the second mounting spacer and into the side wall of the fence post.

12. The method as defined in claim 11, wherein the step of engaging the rail clip housing with the first mounting spacer further includes the step of:

sliding the rail clip housing over the spaced apart first and second mounting spacers.

13. A method of connecting a fence rail to a fence post, said method comprising the steps of:

aligning a first leg of an L-shaped mounting bracket with a mounting spacer;

positioning the aligned mounting bracket and mounting spacer against a side wall of a fence post such that the mounting spacer is sandwiched between the mounting bracket and the side wall of the fence post;

attaching the aligned mounting bracket and mounting spacer to the side wall of the fence post;

engaging a rail clip housing with the mounting spacer;

inserting a rail into a chamber in the rail clip housing;

securing a second leg of the mounting bracket to both of a perimeter wall of the housing and to the rail retained within the chamber.

14. The method as defined in claim 13, wherein the step of engaging a rail clip housing with the mounting spacer further comprises the steps of:

sliding the rail clip housing downwardly over the mounting spacer so that the mounting spacer enters a vertically aligned slot in the rear wall of the housing and the rear wall of the rail clip housing becomes sandwiched between the first leg of the mounting bracket and the side wall of the fence post.

15. The method as defined in claim 14, further comprising the step of:

aligning an aperture in a bottom wall of the rail clip housing over an upper end of the mounting spacer prior to sliding the rail clip housing downwardly over the mounting spacer.

16. The method as defined in claim 13, wherein the step of engaging the rail clip with the mounting spacer includes the step of:

sliding the rail clip housing downwardly over the mounting spacer until an exterior surface of the bottom wall of the rail clip housing comes into abutting contact with the second leg of the mounting bracket.

17. The method as defined in claim 16, further comprising the steps of:

inserting a second fastener through the second leg of the mounting bracket, the bottom wall of the rail clip housing and a wall of the fence rail.

18. A method of connecting a fence rail to a fence post, said method comprising the steps of:

sliding a mounting spacer into a vertical slot in a rear wall of a rail clip housing;

inserting a first leg of an L-shaped mounting bracket into an aperture in a peripheral wall of the rail clip housing, whereby said first leg is disposed within an interior cavity of the rail clip housing;

sliding the mounting bracket upwardly so that the first leg thereof is disposed in abutting contact with both an interior surface of the rear wall of the rail clip housing and with the mounting spacer;

sliding the mounting bracket upwardly until a second leg thereof abuts the peripheral wall of the rail clip housing;

aligning an aperture in said first leg with an aperture in the mounting spacer;

placing a rear surface of the rear wall of the rail clip housing against a side wall of a fence post;

inserting a first fastener through the aligned apertures in the first leg of the mounting bracket and the mounting spacer;

screwing the first fastener into the side wall of the fence post;

inserting an end of a rail into the interior cavity of the rail clip housing;

inserting a second fastener through an aperture in the second leg of the mounting bracket, and screwing the second fastener through the peripheral wall of the rail clip housing and into the rail.

19. The method as defined in claim 18, wherein the step of sliding a mounting spacer into the vertical slot in the rear wall of the rail clip housing includes the steps of:

aligning an aperture in the peripheral wall of the housing over an end of the mounting spacer;

sliding the mounting spacer inwardly into the vertical slot until the end of the mounting spacer abuts an interior end surface of the rear wall of the rail clip housing that defines the vertical slot.

20. The method as defined in claim 19, further comprising the steps of:

sliding a second mounting spacer into the vertical slot in the rear wall of the rail clip housing;

aligning a second aperture in the first leg of the mounting bracket with an aperture in the second mounting spacer;

inserting an additional first fastener through the aligned second aperture in the first leg and second aperture in the second mounting spacer; and screwing the additional first fastener into the side wall of the fence post a distance away from the first fastener.

* * * * *